US006460630B2

(12) United States Patent
Ahtola et al.

(10) Patent No.: US 6,460,630 B2
(45) Date of Patent: Oct. 8, 2002

(54) METHOD AND ROCK DRILLING APPARATUS FOR CONTROLLING ROCK DRILLING

(75) Inventors: Unto Ahtola; Arne Lislerud, both of Tampere (FI)

(73) Assignee: Sandvik Tamrock Oy (FI)

( * ) Notice: Subject to any disclaimer, the term of this patent is extended or adjusted under 35 U.S.C. 154(b) by 0 days.

(21) Appl. No.: 09/875,005

(22) Filed: Jun. 7, 2001

(65) Prior Publication Data

US 2002/0036102 A1 Mar. 28, 2002

Related U.S. Application Data

(63) Continuation of application No. PCT/FI99/01020, filed on Dec. 8, 1999.

(30) Foreign Application Priority Data

Dec. 10, 1998 (FI) ..... 982676

(51) Int. Cl.[7] ..... E21B 47/02
(52) U.S. Cl. ..... 175/45; 33/313
(58) Field of Search ..... 175/24, 26, 40, 175/45; 33/304, 311, 312, 313; 102/311, 312; 299/13

(56) References Cited

U.S. PATENT DOCUMENTS 4,324,297 A 4/1982 Denison
4,445,578 A 5/1984 Millheim
4,524,324 A * 6/1985 Dickinson, III ..... 166/250.17
4,542,647 A * 9/1985 Molnar ..... 175/45
4,733,733 A 3/1988 Bradley et al.
4,797,822 A 1/1989 Peters
4,804,051 A 2/1989 Ho
5,439,064 A * 8/1995 Patton ..... 175/24
5,560,437 A * 10/1996 Dickel et al. ..... 166/254.2
5,747,750 A * 5/1998 Bailey et al. ..... 175/50
5,812,068 A * 9/1998 Wisler et al. ..... 175/40

FOREIGN PATENT DOCUMENTS

EP 0534338 A2 * 3/1993
WO WO 93/12318 6/1993

OTHER PUBLICATIONS

Aimone, C.T. and Dowding, Charles H. (1992). Rock Breakage: Explosives. In H. L. Hartman (Ed.), SME Mining Engineering Handbook, 2nd ed., vol. 1. (pp. 733–735). Baltimore, Maryland: Port City Press, Inc.*

* cited by examiner

*Primary Examiner*—David Bagnell
*Assistant Examiner*—Brian Halford
(74) *Attorney, Agent, or Firm*—Burns, Doane, Swecker & Mathis, L.L.P.

(57) ABSTRACT

A method and a rock drilling apparatus for drilling holes in rock according to a predetermined drilling plan. The method comprises measuring the location of each hole in the rock by inserting a measuring device into the hole, and calculating the deviation of the end of the measured hole from the location determined in the drilling plan. The rock drilling apparatus comprises a measuring device that can be inserted into a drill hole, and means for transferring the measurement values measured by the measuring device to control means of the rock drilling apparatus.

19 Claims, 3 Drawing Sheets

METHOD AND ROCK DRILLING APPARATUS FOR CONTROLLING ROCK DRILLING

Figure 1:
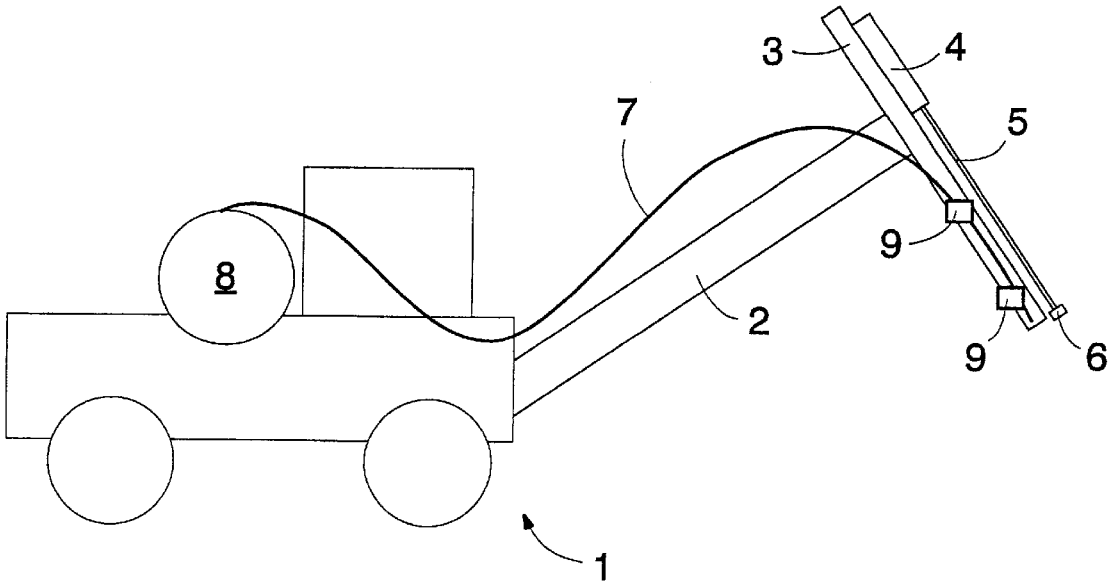

The present application is a continuation of International Application No. PCT/FI99/01020, filed Aug. 12, 1999, which was published in English, and which claims priority to FI982676, filed in Finland on Dec. 10, 1998.

The invention relates to a method for controlling rock drilling, in which method holes are drilled in rock according to a predetermined drilling plan, which determines the length and position of each hole with respect to the other holes in the rock to be drilled in a three-dimensional coordinate system.

The invention also relates to a rock drilling apparatus for drilling holes in rock according to a predetermined drilling plan, the apparatus comprising drilling means for drilling holes in rock, and control means for positioning the drilling means at each hole to be drilled and correspondingly for drilling a hole automatically according to said drilling plan.

It is previously known to use different types of measuring devices for measuring the deviation of a drill hole. The operation of such measuring devices is usually based on a compass, gravitation, inertia or any combination thereof. This type of measuring devices have been used especially in oil drilling technology for checking the direction of a drill hole and also for locating a hole. A problem with these measuring devices has been that the measurement is slow and the devices are large. Therefore, it has not been possible to use measurement of drill hole deviation or the measurement data for controlling drilling in ground excavation during rock drilling, nor for controlling the charging occurring after the drilling. When holes are drilled in rock especially during the excavation of tunnels or blasting of the material to be excavated, the accuracy of the drilling has become more and more important. Especially when drilling long holes, it is rather common that a hole becomes curved and the actual end of the hole is located rather far from the intended end position. Accordingly, the breakage of material, the orientation of a tunnel and other factors take place uneconomically and they may cause additional work and costs.

What is essential for the final result of the blasting is that the deviation of the drill hole and especially the location of the ends of the holes and therefore the relation of the hole ends with respect to one another must be known as accurately as possible in order that the blasting could be implemented in a desired manner. The purpose of the present invention is to provide a method and an apparatus which enable effective, accurate and rapid implementation of measurements and which also make it possible to change a predrafted drilling plan during the drilling, if required.

The method according to the invention is characterized by measuring at least the actual location of the end of at least predetermined drill holes in the rock by inserting or lowering into the drill hole a measuring device, which indicates its current location with respect to the rock in the three-dimensional coordinate system, calculating the deviation of the end of the measured hole from the location of the end determined in the drilling plan, and changing the drilling plan according to the calculated deviation.

The rock drilling apparatus according to the invention is characterized in that it comprises a measuring device that can be inserted or lowered into a drill hole, and feeding means for inserting or lowering the measuring device into the drill hole and for pulling it out of the hole, and transferring means for transferring the measurement values measured by the measuring device to the control means.

The basic idea of the invention is that a measuring device is inserted into a drill hole in order to measure at least the location of the hole end with respect to the rock in a three-dimensional coordinate system so as to determine the position of the hole end compared to the original drilling plan and thus with respect to the other holes.

Another basic idea of the invention is that the measurement result of the measuring device can be used, if required, to change the drilling plan of one or several successive holes or even to drill extra holes. A preferred embodiment of the invention comprises a separate feeding device with which an inertia measuring device is inserted into a drill hole directly after the drilling so that a measurement result is obtained immediately before the drilling apparatus is moved to the drilling point of the next hole, and required changes can be made before the drilling is started. According to another preferred embodiment of the invention, the measuring device is placed at the end of a feed hose that does not bend while it is pushed, so that the measuring device can be inserted into the hole and pulled out of it easily by using suitable mechanical feeding means for feeding the hose into the hole and for pulling it therefrom. According to a third preferred embodiment of the invention, the measuring device is fed into the hole simultaneously with the drill bit and the measurement is thus carried out simultaneously with the drilling. According to a fourth preferred embodiment of the invention, the measuring device is an inertia measuring device, which is inserted into the drill hole at such a speed that a reliable measurement result is obtained. Thus, if the initial point of the drill hole is known, it is possible to measure reliably the location of the hole end and, if required, the shape and direction of the hole continuously along the entire length of the hole.

The invention has an advantage that it enables measuring, simply and rapidly, the final location of the end of a drilled hole and also the shape and position of the entire hole. If required, it is thus possible to change the drilling plan so that the holes can be located suitably with respect to one other for the blasting. Depending on the application, the end of the drill hole may refer to only the final end of the hole or to a predetermined length of the hole from the hole end towards the beginning thereof. The invention is easy to implement and automate, so that the operator does not have to make any special calculations, but an automatic control system attends to the operation of the apparatus automatically.

Figures 2A, 2B, 2C:
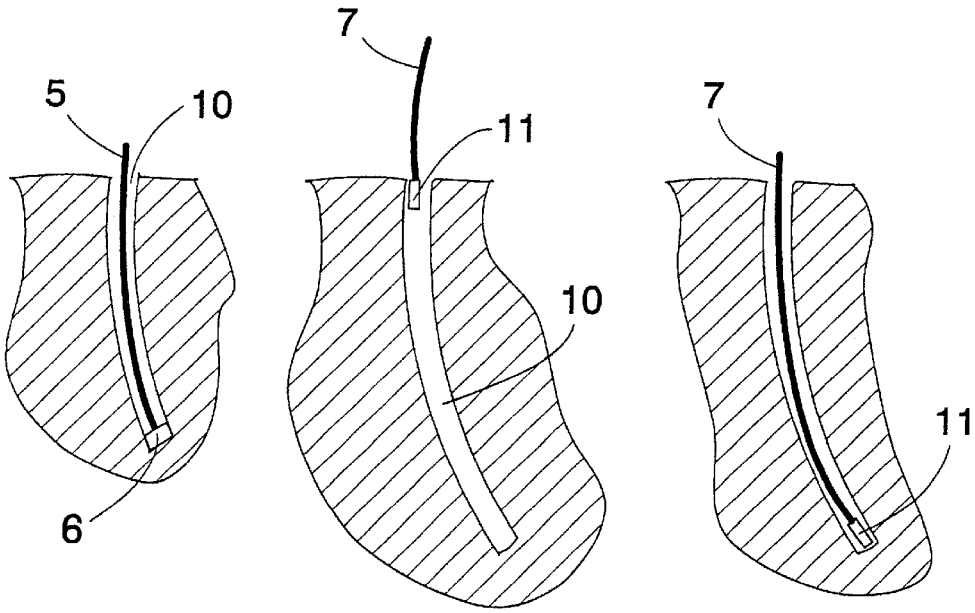
Figure 3:
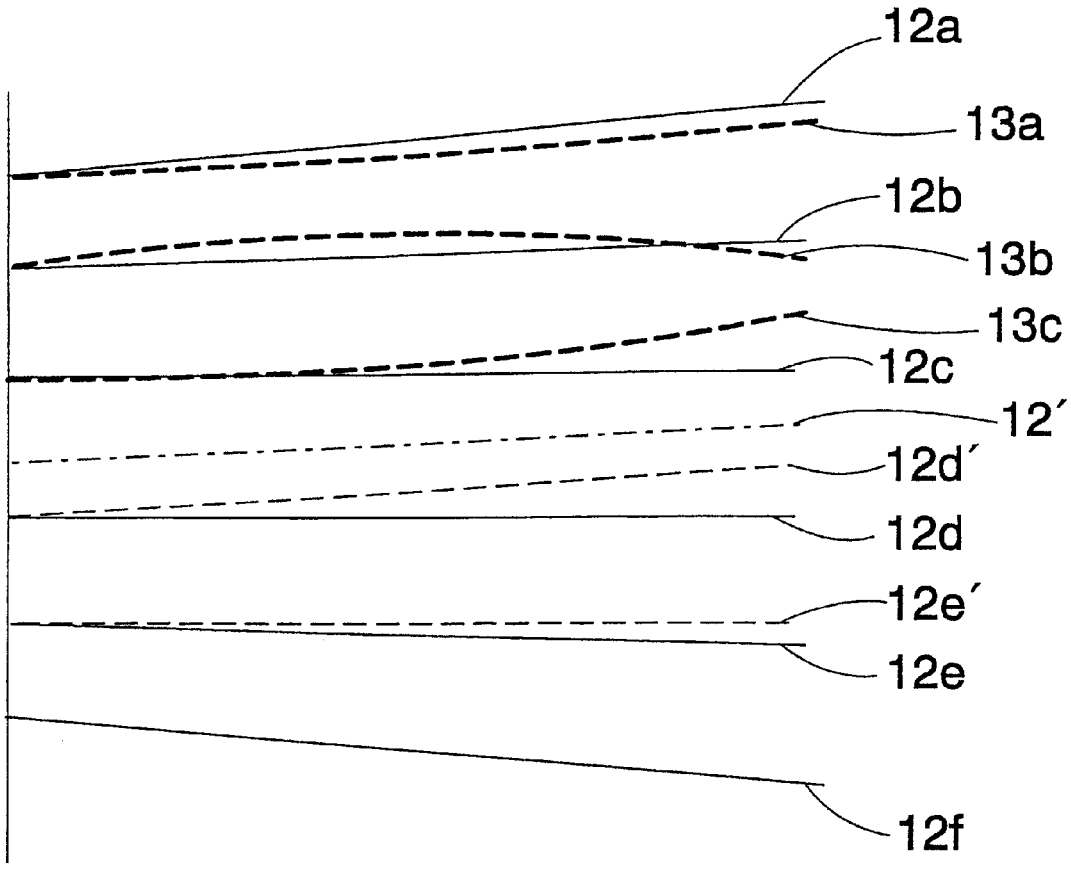
Figure 4A:
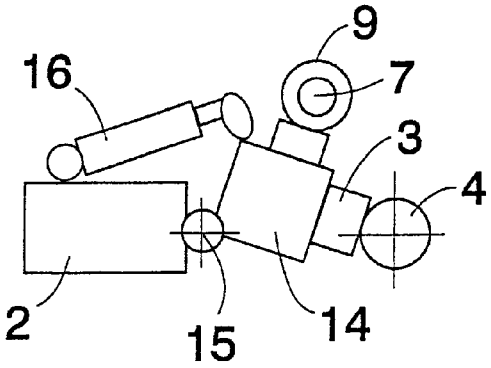
Figure 4B:
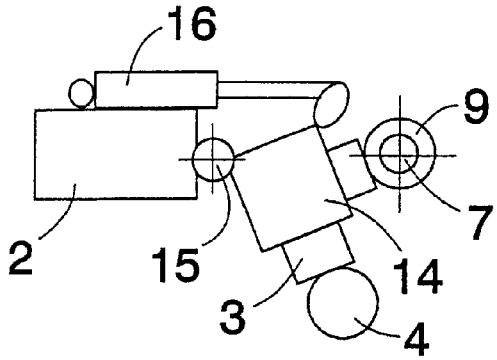
Figure 5:
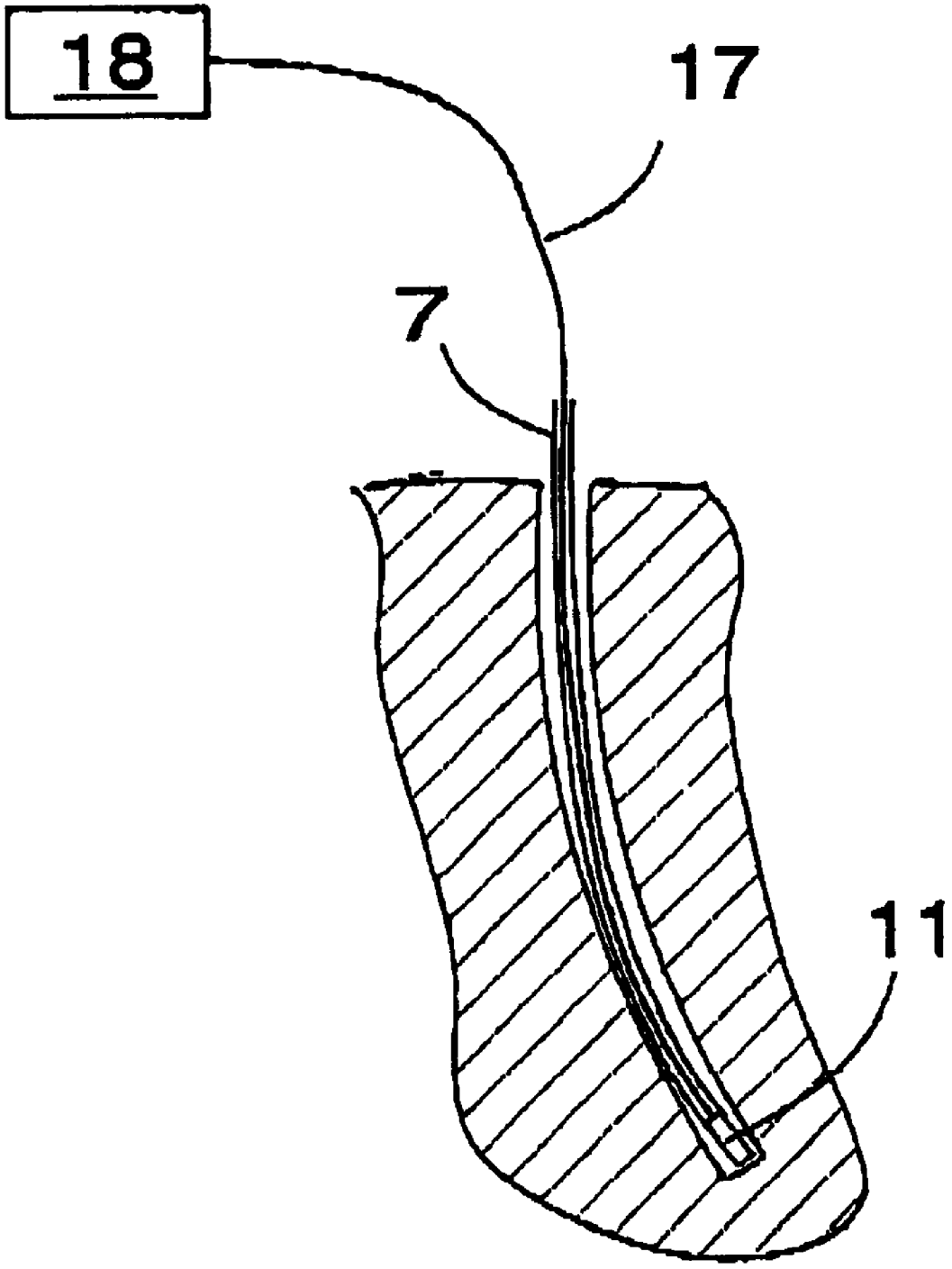

The invention will be described in greater detail in the accompanying drawings, in which FIG. 1 shows schematically a rock drilling apparatus, FIGS. 2*a* to 2*c* show schematically implementation of the method according to the invention in measuring a hole, FIG. 3 shows schematically application of the method according to the invention for changing a drilling plan, FIGS. 4*a* and 4*b* shows schematically a positioning device for positioning a drill bit and a measuring device at a drill hole , and FIG. 5 schematically shows a rock drilling apparatus including a cable extending through a hose for connecting a measuring device to a control device.

FIG. 1 shows schematically a rock drilling apparatus intended for drilling a hole in rock. The rock drilling apparatus comprises a carrier 1 to which a boom 2 is connected in a manner known per se, the boom being preferably turnable with respect to the carrier 1 in different positions in a known manner. The end of the boom 2 away from the carrier is provided with a drilling device in a manner known per se. The drilling devices are known per se, wherefore they will be described generally below. At the end of the boom 2 there is a feeding beam 3 of the rock drilling apparatus, connected to the boom either directly or via a separate cradle structure or the like that is known per se. A rock drilling machine 4 moves along the feeding beam during the drilling. The rock drilling machine 4 is in turn connected to a drill rod 5, the end of which is provided with a drill bit 6. When longer holes are drilled, the drill rod 5 usually consists of extension rods that are connected together in order to drill a hole that is longer than the mere feeding length of the feeding device. The figure further shows a reel 8 of a device 7 for feeding the measuring device, and control means 9 for controlling the flexible feeding device, which is preferably a feed hose that can be pushed without bending.

When such an apparatus is used to drill holes in rock, both excavation of a tunnel and ore extraction and rock excavation employ predrafted drilling patterns that determine the holes required for blasting and the location of the holes with respect to each other in the rock. Also, especially in tunnel excavation it is sometimes necessary to drill grout holes around the projected tunnel profile before the excavation, so that cement or some other sealing material can be pumped into the holes to prevent leakages. The grout holes are also drilled according to a predetermined drilling plan or drilling pattern, which determines the holes and the positions thereof with respect to one another.

This can be carried out mathematically in different ways, which often include determining the initial points of the holes as well as their direction and distance from a certain plane, or the location of the end of a hole with respect to the rock in a three-dimensional coordinate system. Presently, the drilling is often carried out automatically, which means that the control means of the drilling apparatus comprise a computer where the drilling plan is stored. Thus, the position of the drilling apparatus with respect to the rock is defined such that the computer can automatically implement the drilling of the holes in a suitable order on the basis of the drilling plan.

FIG. 2*c* shows how the measuring device 11 is inserted into the hole 10 at a suitable speed, so that as the device moves it stores its location defined in a certain manner in the three-dimensional coordinate system, where the drilling plan is also determined with respect to the rock. The measuring device 11 can be arranged, for example, to store its location at predetermined intervals, for instance at intervals of 1 to 2 seconds. Accordingly, when the feed hose 7 is inserted at a constant speed, the position of the inertia measuring device is obtained as a function of the length of the drill hole 10 from the beginning of the hole. When the location of the measuring device at the beginning of the hole is known, it is possible to measure the shape of the hole and to correspondingly determine the position of the hole with respect to the rock in the three-dimensional coordinate system and thus with respect to the drilling pattern. The measuring device can also be arranged to input data about its location nonstop, which results in a signal that continuously indicates the shape of the curve. In this embodiment, the measuring device can be used for example in such a way that it operates with its own power source and stores the readings in its memory while it is inserted into the hole. In such a case, the data stored in the memory must be transferred to the control unit of the rock drilling apparatus for example via a radio path or in some other manner, preferably by a wireless communication system. Alternatively, as seen in FIG. 5, the measuring device 11 can be connected directly to the control unit 18 of the rock drilling apparatus by a cable 17 passing through the feed hose, so that the measurement values provided by the device are transmitted directly to the control unit, which may FIG. 2*c* shows how the measuring device 11 is inserted into the hole 10 at a suitable speed, so that as the device moves it stores its location defined in a certain manner in the three-dimensional coordinate system, where the drilling plan is also determined with respect to the rock. The measuring device 11 can be arranged, for example, to store its location at predetermined intervals, for instance at intervals of 1 to 2 seconds. Accordingly, when the feed hose 7 is inserted at a constant speed, the position of the inertia measuring device is obtained as a function of the length of the drill hole 10 from the beginning of the hole. When the location of the measuring device at the beginning of the hole is known, it is possible to measure the shape of the hole and to correspondingly determine the position of the hole with respect to the rock in the three-dimensional coordinate system and thus with respect to the drilling pattern. The measuring device can also be arranged to input data about its location nonstop, which results in a signal that continuously indicates the shape of the curve. In this embodiment, the measuring device can be used for example in such a way that it operates with its own power source and stores the readings in its memory while it is inserted into the hole. In such a case, the data stored in the memory must be transferred to the control unit of the rock drilling apparatus for example via a radio path or in some other manner, preferably by a wireless communication system. Alternatively, the measuring device can be connected directly to the control unit of the rock drilling apparatus by a cable passing through the feed hose, so that the measurement values provided by the device are transmitted directly to the control unit, which may continuously monitor and change the drilling plan of the next drill hole(s), if required. The measuring device can also be fed all the way to the drill bit via a drilling pipe.

The inertia measuring device used according to a preferred embodiment of the invention is known per se. When the device is employed in the three-dimensional coordinate system, it is based on three gyroscopic discs placed perpendicularly with respect to one other and rotating around an axis. The discs are used to accurately measure the acceleration and speed of motion of the measuring device in different directions. The essential feature of the measurement is that the speed of motion from the starting point is sufficiently fast in the drill hole during the measurement, so that changes can be measured accurately enough. Such devices are commercially widely available and they are generally known, wherefore they will not be described in greater detail herein.

FIG. 3 shows schematically how the drilling plan can be changed by means of the measuring method and device according to the invention. The figure shows with solid lines a preliminary drilling plan which includes holes 12*a* to 12*f* that are to be drilled on the same plane, one solid line corresponding to one planned hole. FIG. 3 further shows with thick broken lines 13*a* to 13*c* the holes that have actually been drilled, whereas thin broken lines 12*d*' and 12*e*' show the places of the new holes according to the drilling plan changed in accordance with the measurement of the drilled holes.

As shown in the figure, the drilled holes 13*b* and 13*c* are curved and their ends are situated rather close to one another. Correspondingly, in order that it would not be necessary to drill more holes than designed in the plan, the direction of the rest of the holes has been changed in the drilling plan so that the holes are positioned more evenly in the area of the remaining rock without great distances between any two holes. The drilling plan was changed when the measuring device 11 had measured the shape of the last hole 13*c* and its position in the rock. In practice, the drilling plan does not have to be changed due to small deviations if the rest of the holes remain in place accurately enough. Alternatively, it would have been possible to keep the holes 12*d* to 12*f* in their old places according to the plan, and an extra hole denoted by a dot-and-dash line 12' could have been added between the drilled hole 13*c* and the planned hole 12*d*. Further, the data about the deviation of the holes can also be used to optimize the charging plan, for example by adjusting the density of charge in relation to the actual distances between the holes. Therefore, the amount of blasting agent required for different holes and even the placement of specific charges can be calculated separately on the basis of the shapes of the measured holes and/or the position of the hole ends.

However, by measuring changes in the direction of the hole or the curvature of the hole along its length, it is also possible to predict to some extent the curvature and direction of the next holes and to take it into account in determining a new location for the holes in the drilling plan.

FIGS. 4*a* and 4*b*, in turn, show schematically how the rock drilling apparatus and the inertia measuring device can be placed at the beginning of a hole. In this arrangement known per se in rock bolting apparatuses, the feeding beam and correspondingly the control means 9 of the feed hose 7 are connected to the same frame 14, which is in turn connected to be turned around a longitudinal axis 15 of the feeding beam 3 by a separate actuator 16. When the actuator has turned the feeding beam 3 counter-clockwise as shown in FIG. 4*a*, the drill rod and the drill bit of the rock drilling apparatus are positioned at the hole to be drilled. Correspondingly, when the actuator turns the feeding beam and the control means clockwise, the control means and thus the end of the feed hose are positioned at the beginning of the hole. As shown in FIG. 4*b*, the feed hose of the measuring device can be positioned at a drilled hole in several manners known per se, but this arrangement is rather simple and easy to implement.

The invention is described above by way of an example shown in the drawings, and it is not restricted thereto in any way. The invention can be applied in both vertical and horizontal rock drilling and also upwards and downwards. In order for a measurement to be carried out substantially at a constant speed, and the location of the measurement points to be determined accurately in the longitudinal direction of a hole, it is necessary to use a pushing device, such as a rather stiff and still flexible feed hose or the like, comprising at its end the measuring device. The measuring device can thus be pushed to the end of the hole reliably and the measurement results can be used for determining both the shape of the drilled holes and the location of the hole end, as well as for changing the drilling plan, if required. It is essential that measurement takes place automatically whenever needed, and that the measurement results are transferred to the control unit, such as a computer, comprised in the control means of the rock drilling apparatus to be used directly, so that the drilling plan is changed before the drilling on the basis of the measurement results.

What is claimed is:

1. A method for controlling rock drilling, in which method holes are drilled in rock according to a predetermined drilling plan, which determines the length and position of each hole with respect to the other holes in the rock to be drilled in a three-dimensional coordinate system, including measuring at least the actual location of the end of at least predetermined drill holes in the rock by inserting or lowering into the drill hole a measuring device, which indicates its current location with respect to the rock in the three-dimensional coordinate system, calculating the deviation of the end of the measured hole from the location of the end determined in the drilling plan, and changing the drilling plan according to the calculated deviation.

2. A method according to claim 1, wherein the position of the non-drilled holes in the drilling plan is changed before the drilling.

3. A method according to claim 1, wherein a required number of new holes are added to the drilling plan.

4. A method according to claim 1, wherein each drilled hole is measured, and the drilling plan is changed after the measurement of each hole, if required.

5. A method according to claim 1, wherein the deviation of a hole is measured at predetermined intervals along the entire length of the hole.

6. A method according to claim 1, wherein the deviation of a hole is measured substantially continuously.

7. A method according to claim 1, wherein the measurement is carried out substantially immediately after the hole has been drilled.

8. A method according to claim 7, wherein a measuring device is inserted into the drill hole and pulled out of it by means of a flexible elongated pushing device, preferably a hose.

9. A method according to claim 1, wherein the measurement is carried out during the drilling.

10. A method according to claim 1, wherein the measuring device is arranged to be in continuous contact with the control means of the rock drilling apparatus, and that the measurement values of the device are transferred substantially continuously to the control means of the rock drilling apparatus during the measurement.

11. A method according to claim 1, wherein the measurement values of the measuring device are stored in a memory of the device during the measurement and transferred to the control means of the rock drilling apparatus after the measuring device has been pulled out of the hole.

12. A method according to claim 1, wherein the measuring device is an inertia measuring device.

13. A method according to claim 1, wherein the amount and position of the blasting agent used in blasting is determined for each hole on the basis of the measurement of the holes.

14. A rock drilling apparatus for drilling holes in rock according to a predetermined drilling plan, the apparatus comprising drilling means for drilling holes in rock, and control means for positioning the drilling means at each hole to be drilled and correspondingly for drilling a hole automatically according to said drilling plan, wherein it comprises a measuring device that can be inserted or lowered into a drill hole, and feeding means for inserting or lowering the measuring device into the drill hole and for pulling it out of the hole, and transferring means for transferring the measurement values measured by the measuring device to the control means.

15. A rock drilling apparatus according to claim 14, wherein the means for feeding the measuring device into the drill hole comprise an elongated flexible device at the beginning of which the measuring device is positioned, a reel for storing the flexible device, feeding means for inserting the flexible device into the drill hole, and positioning means for positioning the drilling means and the flexible device for drilling and correspondingly for measurement at the drill hole.

16. A rock drilling apparatus according to claim 15, wherein the flexible device is a hose.

17. A rock drilling apparatus according to claim 16, wherein the transferring means for transferring the measurement values comprise a cable which is passed inside the hose and with which the measuring device is connected to the control means.

18. A rock drilling apparatus according to claim 14, wherein it comprises transferring means for transferring the memory data stored in the memory of the measuring device to the control means wirelessly.

19. A rock drilling apparatus according to claim 14, wherein the measuring device is an inertia measuring device.

* * * * *